US005230677A

United States Patent [19]

Chi

[11] Patent Number: 5,230,677

[45] Date of Patent: Jul. 27, 1993

[54] MAGNETIC ADJUSTING DEVICE OF A SKI SIMULATOR

[76] Inventor: Wu H. Chi, No. 1-2, Lane 975, Chun-Jih Road, Tao-Yuan City, Taiwan

[21] Appl. No.: 2,021

[22] Filed: Jan. 8, 1993

[51] Int. Cl.[5] ..... A61B 23/00

[52] U.S. Cl. ..... 482/70; 482/71; 482/903; 434/253

[58] Field of Search ..... 482/70–72, 482/4–7, 903; 434/253

[56] References Cited

U.S. PATENT DOCUMENTS 4,700,013 2/1990 Rodgers, Jr. ..... 482/70
4,948,121 8/1990 Hanheim et al. ..... 482/70
4,960,276 10/1990 Feuer et al. ..... 482/70

*Primary Examiner*—Richard J. Apley
*Assistant Examiner*—Glenn E. Richman
*Attorney, Agent, or Firm*—Morton J. Rosenberg; David I. Klein

[57] ABSTRACT

A load adjusting device for the ski stimulator, particularly to the magnetic load adjusting device which is mounted in the rear housing of the ski stimulator, commprises two guiding rollers installed on the front housing in front of the guiding track respectively, three timing wheels mounted in the same plane interconnected with a timing belt, a magnetic braking mechanism, a spindle, a hub member, a bearing and a one-way bearing. Wherein the guiding roller can rotate clockwise and counterclockwise, and the timing wheels can only rotate one-way. The strap has at least one winding on the guiding roller to prevent any skip thereof.

2 Claims, 7 Drawing Sheets

MAGNETIC ADJUSTING DEVICE OF A SKI SIMULATOR

BACKGROUND OF THE INVENTION

This invention relates to a load adjusting device, and more particularly, to a magnetic adjusting device which can be used on a ski simulator for the adjustment of the load.

The ski simulator have been widely accepted by the people, especially in the European and North America, since it provides a sound exercise indoors. Basically, it includes a load device and the user can set a suitable load (resistance) depending on his/his own physical condition. In the prior art, as shown in FIG. 7, the adjustment of the load device is via setting the tension of the braking wires by moving the braking disk b to and fro manually. Because of the limitation of its structure, the user can hardly reach a suitable load amount for his/her own exercise. Besides, it takes time and is uneasy to reach a sound adjustment of the load.

Basically, the user changes the load always during the exercise, such as downhill or uphill, to imitate the real situation. As in ski, both hands and legs are moving. If the user hopes to adjust the load, he/she has to stop first, then sets a suitable load, then starts again. Obviously, the ski exercise is inevitably interrupted. Not only the effect is largely reduced, but also this is not good to the user.

The magnetic braking mechanism has been successfully applied to sport equipment. The inventor has invented a "Magnetic Adjustable Braking Device", which had been issued a Taiwan Utility Patent, No. 59007 and "Magnetic 3-Phase AC Braking Device", publication No. 176285. Those two inventions have also been successfully applied to sport equipment. Even this magnetic braking device can rotate forwardly and reversely, but in practice, its function is limited by the rotating inertia and it can only be used on a one-way rotation. But to sport equipment which needs to rotate forwardly and reversely, such as the ski simulator, the magnetic breaking device can not be applied.

In reality, this magnetic braking device can provide a very sound adjustment on the load of the sport equipment and is the best for this purpose. The manufacturer always seek to a find out a feasible way to apply ever best mechanism on the ski simulator.

SUMMARY OF THE INVENTION

It is the primary objective of this invention to provide a magnetic load adjusting device incorporated with a magnetic braking mechanism and a group of guiding rollers interconnected with a timing belt so as to set an appropriate load amount for the ski stimulator.

BRIEF DESCRIPTION OF THE DRAWINGS

The structural and operational characteristics of the present invention and its advantages as compared to the known state of the prior art will be better understood from the following description, relating to the attached drawings which show illustratively but not restrictively an example of a braking disk of a load device. In the drawings.

DETAILED DESCRIPTION OF THE PREFERRED EMBODIMENT

Figure 1:
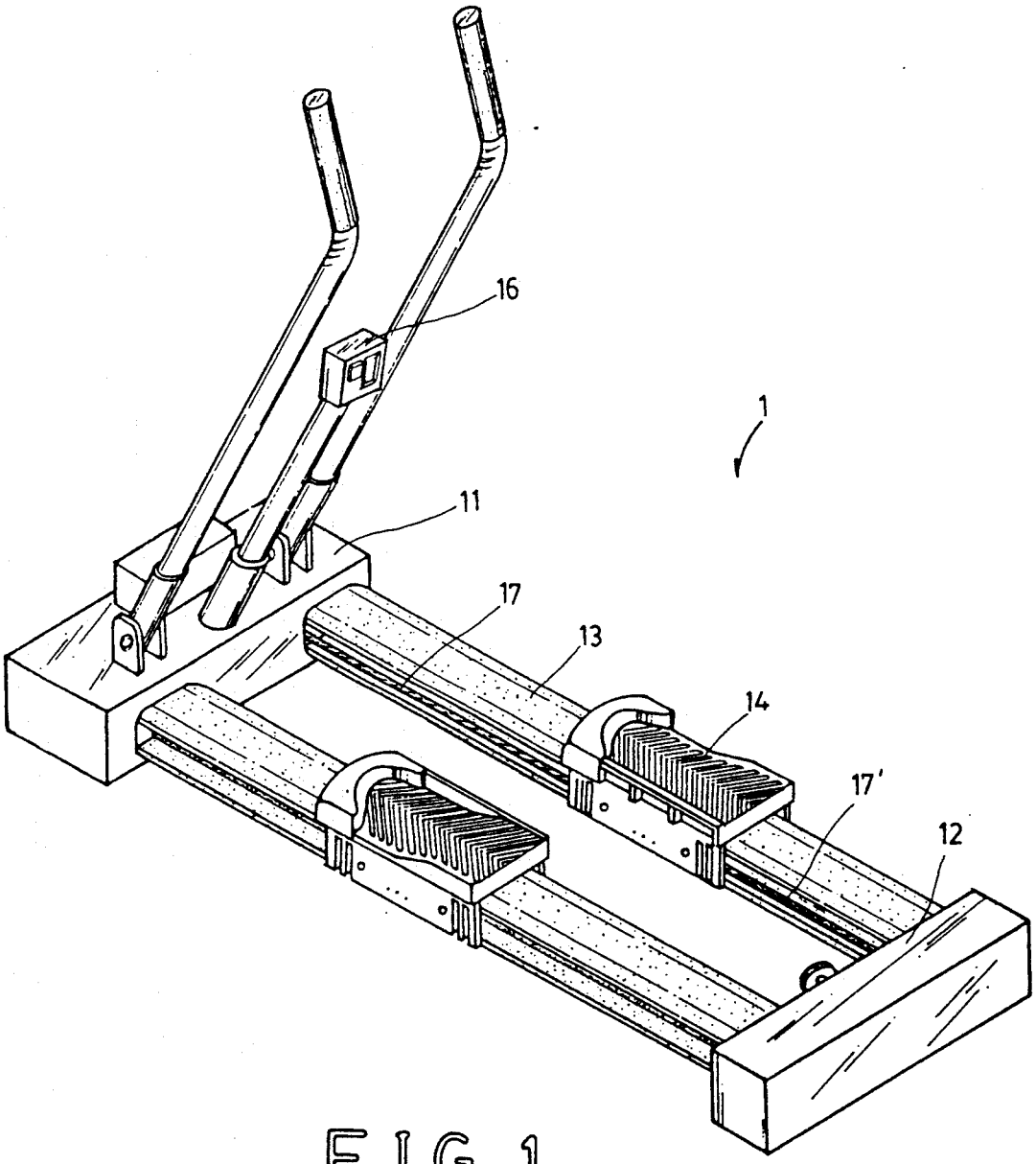
FIG. 1 is a perspective view of a ski simulator according to this invention.

Please refer to FIG. 1, the ski simulator according to this invention includes a front housing 11, a rear housing 12 and two guiding tracks 13 disposed parallel between the front housing 11 and rear housing 12. The guiding tracks 3 are provided with sliding pedals 14 respectively. The sliding pedals 14 are interconnected with a front moving strap 17 and a rear moving strap 17'. A pair handbar members 15 pivoted on the front housing 11 providing a support of the user. The guiding roller are installed in the front housing of ski stimulator, not shown in FIG. 1. The ski simulator is also provided with a controller display 16.

Figure 2:
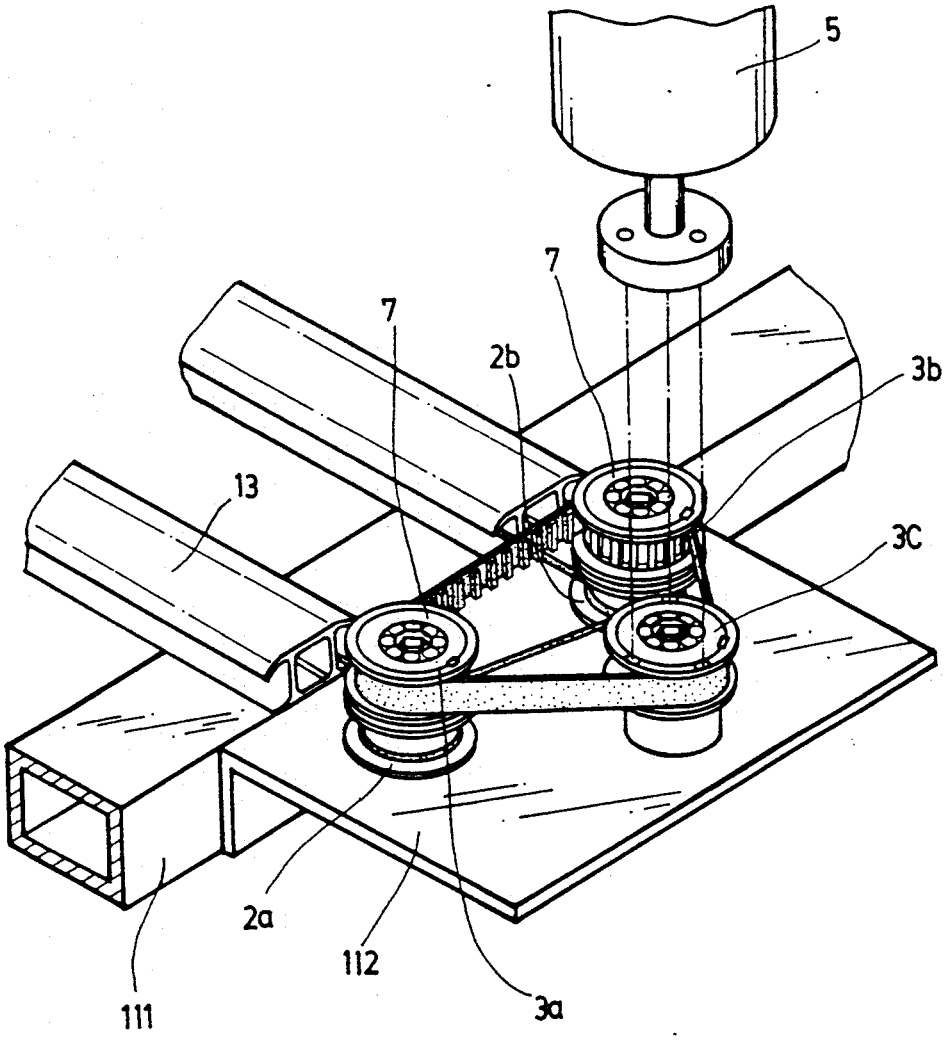
FIG. 2 is a exploded perspective view of the magnetic load adjusting device of the ski simulator according to this invention.

Please refer to FIG. 2, the guiding roller according to this invention is installed on the front housing 11 which embodied a rectangular tube 111. A pair of guiding tracks 13 are mounted thereon. A L type bracket 112 is attached to side wall and the guiding rollers are mounted thereon. The transporting mechanism comprises a pair of guiding roller **2*a*, 2*b* installed in front of the guiding track 13 respectively. Three timing wheels 3*a*, 3*b*, 3*c* mounted in the same plane interconnected with a timing belt 4, a magnetic braking mechanism 5, a spindle 6, a hub member 7, a bearing 8 and a one-way bearing 9. Wherein two of the timing wheels 3*a*, 3*b* are mounted above the guiding roller 2*a*, 2*b* which use the same hub member 7. The magnetic braking mechanism 5 is connected to the timing wheel 3*c*. Those three timing wheels 3*a*, 3*b*, and 3*c* are interconnected by the timing belt 4 to rotate concurrently but one way because the braking mechanism 5** can rotate only one way.

Figure 3:
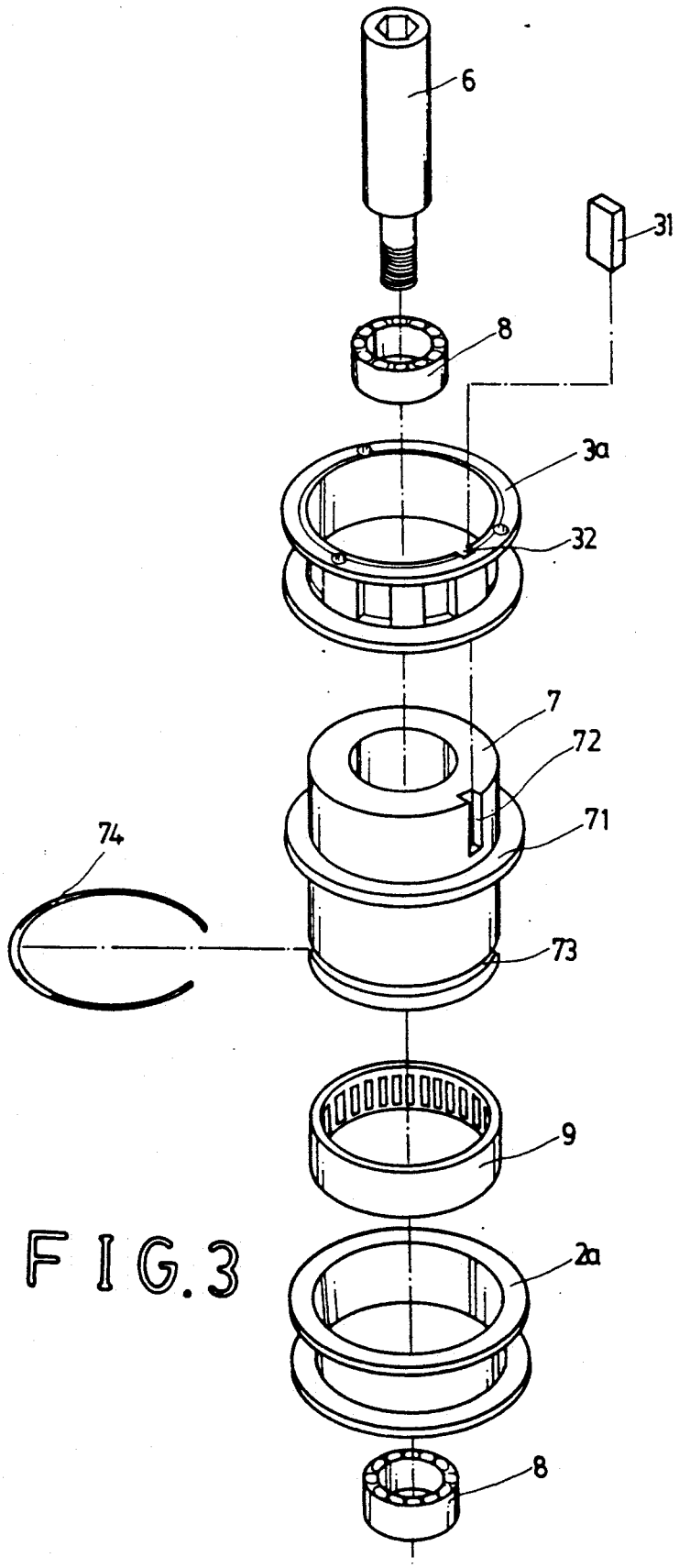
FIG. 3 is a exploded perspective view of the guiding roller according to this invention.

For the detailed relationship between the timing wheel and the transporting wheel, it is described herein as refer to FIG. 3. The hub member 7 is fixed on the spindle 6 through a upper and lower bearing 8, this makes the hub member 7 rotate freely on the centered spindle 6. The middle portion of the outer surface of the hub member 7 is provided with a rim portion 71 which provide a seat for the timing wheel. Both the hub member 7 and timing wheel 3 are provided with a key slots 72, 32. A key member 31 is insert into the key slots 72, 32 to prevent the timing wheel rotating freely thereon. The hub member 7 further includes a annular slot 73 and a one-way bearing 9 is received and fixed thereof by a clip member 74.

Figure 4:
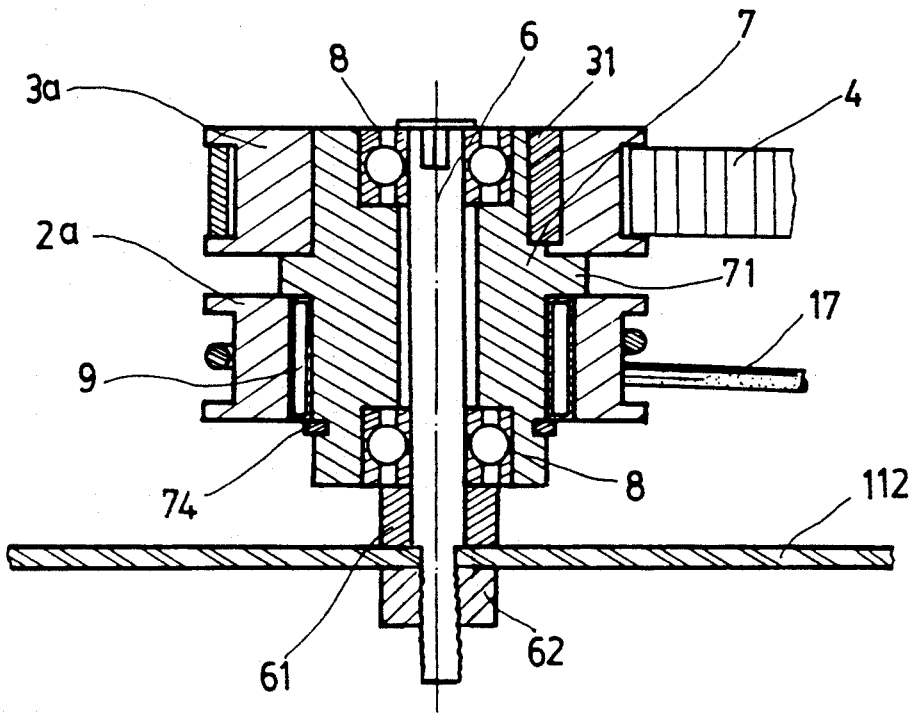
FIG. 4 is a cross-sectional view showing the mechanism of the guiding roller according to this invention shown in FIG. 3.

The assembled structure is described in FIG. 4, the spindle 6 is installed on the bracket 112 by means of a gasket 61 and a nut member 62. The guiding wheels **2*a* can rotate freely with respect to the hub member 7. As the pedal members 14 move forwardly and backwardly, the guiding wheel 2a(2b) can rotate concurrently with the strap 17. But the timing wheel 3a, 3b which are keyed on the hub member 7 can rotate only one way, hence a one-way bearing 9 is provided for this purpose. This makes the timing wheel 3a rotatable in only one direction on the guiding roller 2a**.

Figure 5:
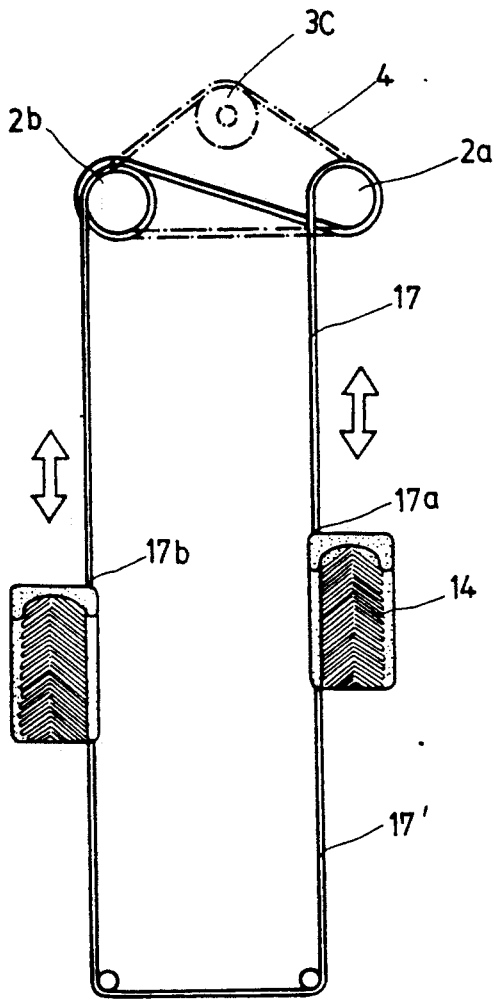
FIG. 5 is a ,top sketch view showing the transporting route of the ski simulator incorporated with a magnetic load adjusting device according to this invention.
Figure 6:
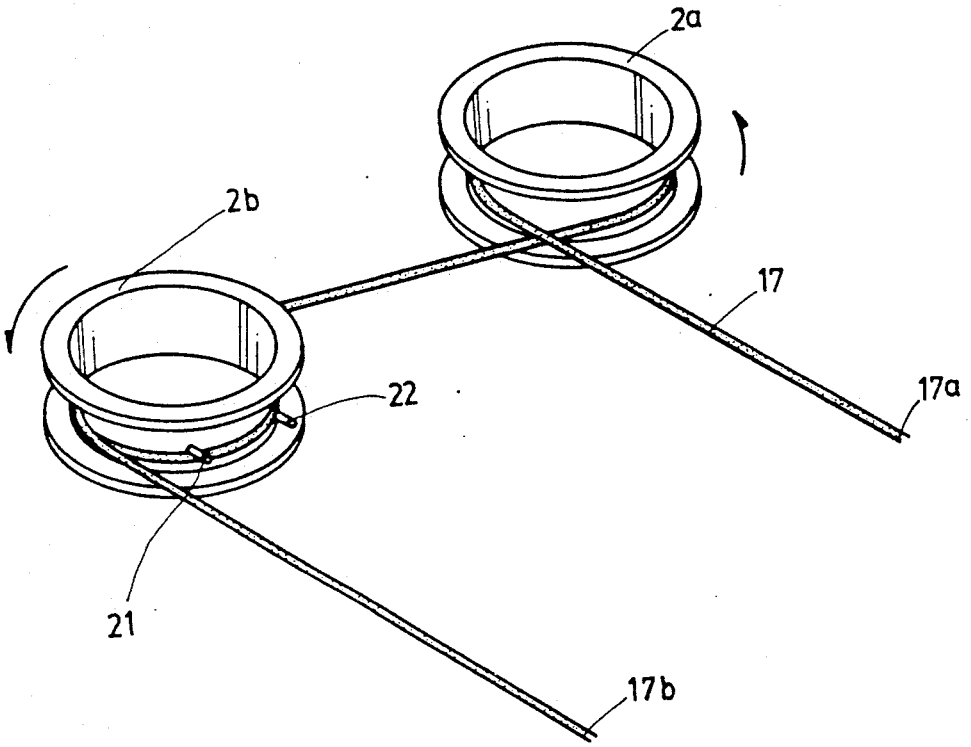
FIG. 6 is a perspective view showing two rotating wheel mounted on the transporting mechanism according to this invention; and ,FIG. 7 is a load adjusting device used on a ski simulator used on a ski stimulator.
Figure 7:
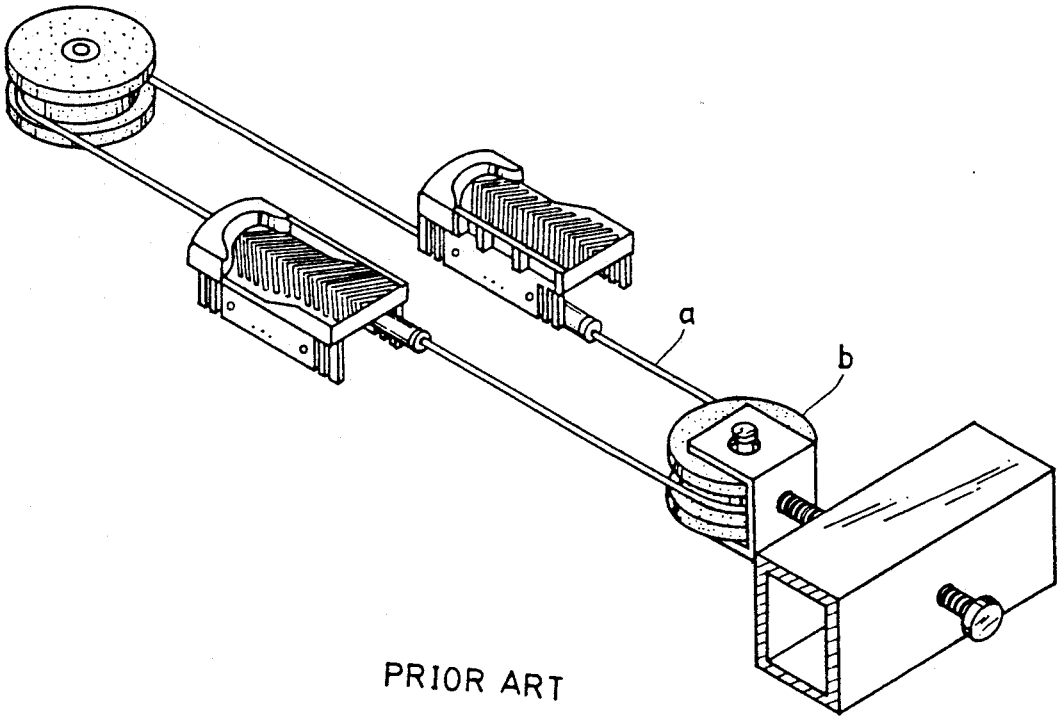
PRIOR ART FIG. 7

Please refer to FIG. 5, the strap 17 is attached to the pedal block 14 at its free ends 17a. Before the front strap 17 is attached to the pedal block 14, it has a winding on the guiding wheel 2a and a reverse winding on the guiding 2b. The pedal blocks 14 are then connected by a rear strap 17' and jointly construct a closed loop. The winding of the strap 17 on those two guiding rollers 2a, 2b shall be at least one winding to prevent the skipping of the strap 17 respect to guiding rollers 2a, 2b. Besides, the outlet of the winding of the strap 17 on the guiding rollers 2a, 2b shall at the same side. As the pedal block 14 of right leg moves down to pull the strap 17a, the guiding roller 2a will rotate counterclockwise, and the guiding roller 2b rotate clockwise freely without actuating the timing wheel 2b. As the magnetic braking mechanism 5 is mounted on the timing wheel 3c, as shown in FIG. 2, hence it creates a instant load responding to the rotation of guiding wheel 2a. 0n the other hand, as the pedal block 14 of left leg moves down, the front strap 17b is pulled down, the guiding wheel 2b rotates counterclockwise, and the guiding wheel 2a rotates freely clockwise, then the guiding wheel 2b will actuate the timing belt 4 rotating counterclockwise, and an instant load provided by the magnetic braking mechanism 5. By the alteration of the right and left legs, each leg will withstand the load provided by the magnetic braking mechanism 5.

In the above description, the strap has one winding on the guiding roller 2a, 2b to prevent the skipping of the strap 17 respect to the guiding roller 2a, 2b. In case the windings are more than one, the guiding roller 2a, 2b are provided with projections 21, 22 to separate the windings. The strap 17 can wind onto the guiding roller 2a, 2b one by one above, between and below the partition defined by the projections 21, 22. This has been tested that it provides a positive result in separate windings.

The magnetic load adjusting device according this invention can be concluded with the followings:

1. The magnetic braking mechanism can provide a accurate adjustment of the load needed for the ski simulator. The difficultly of this magnetic braking mechanism has, been solved and it can be applied to sport equipment successfully. It has reached a high level which the prior can never achieve.

2. Since the guiding roller 2a, 2b can rotate back and forth, but the transporting wheel can only rotate one way. The unique design benefit the left/right leg withstanding the load provided by the magnetic braking mechanism alteratively.

3. The windings of the strap 17 can avoid any skipping of the strap respect to the guiding roller, and the provision of the projections can separate the windings with any difficulty.

4. The magnetic braking mechanism can provide a sound load for the ski simulator. The structure is compact and simple.

Although the present invention has been described in connection with the preferred embodiment thereof, many other variations and modifications will now become apparent to those skilled in the art without departing from the scope of the invention. It is preferred, therefore, that the present invention not be limited by the specific disclosure herein, but only by the appended claims.

I claim:

1. A load adjusting device for the ski stimulator, ski stimulator basically comprises a front housing, a rear housing and two guiding tracks disposed parallel between the front housing and rear housing, said guiding track being provided with a sliding pedal respectively, said sliding pedals are interconnected with a front moving strap and a rear moving strap, a pair of handbar members being pivoted on the front housing providing a support of the user, a magnetic load adjusting device being mounted in said front housing, said magnetic load adjusting device comprising:

two guiding rollers installed on the front housing in front of said guiding tracks respectively, three timing wheels mounted in the same plane interconnected with a timing belt, a magnetic braking mechanism, a spindle, a hub member, a bearing and a one-way bearing, wherein two of the timing wheels being mounted above the guiding roller using the same hub member, said magnetic braking mechanism being connected to the third timing wheel, those three timinq wheels being interconnected by the timing belt to rotate concurrently in one direction, said hub member being fixed on said spindle through upper and lower bearings, making the hub member rotate freely centered on spindle, the middle portion of the outer surface of said hub member being provided with a rim portion providing a seat for the timing wheel, said hub member and timing wheels being provided with key slots and key members being inserted into said key slots to fix said timing wheels thereof, said hub member further including a annular slot and one-way bearing being received and fixed thereof by a clip member; said straps being wound up on said guiding rollers having at least one winding, the outlet of said winding of said guiding rollers and connected said pedal blocks respectively.

2. A magnetic load adjusting device as recited in claim 1, wherein said guiding rollers are provided with projections to define a partition thereof.

* * * * *